US007450077B2

(12) United States Patent
Waterhouse et al.

(10) Patent No.: US 7,450,077 B2
(45) Date of Patent: Nov. 11, 2008

(54) ANTENNA FOR EFFICIENT BODY WEARABLE APPLICATIONS

(75) Inventors: Rodney Waterhouse, Columbia, MD (US); Dalma Novak, Columbia, MD (US); Austin Farnham, Severna Park, MD (US)

(73) Assignee: Pharad, LLC, Glen Burnie, MD (US)

( * ) Notice: Subject to any disclaimer, the term of this patent is extended or adjusted under 35 U.S.C. 154(b) by 97 days.

(21) Appl. No.: 11/451,316

(22) Filed: Jun. 13, 2006

(65) Prior Publication Data

US 2007/0285324 A1 Dec. 13, 2007

(51) Int. Cl.
*H01Q 1/12* (2006.01)

(52) U.S. Cl. ..... 343/718; 343/718; 343/700 MS; 343/895; 343/767

(58) Field of Classification Search ..... 343/718
See application file for complete search history.

(56) References Cited

U.S. PATENT DOCUMENTS

| | | | | |
|---|---|---|---|---|
| 4,373,162 | A * | 2/1983 | Peterson | 343/771 |
| 5,884,198 | A | 3/1999 | Kese et al. | |
| 5,986,587 | A * | 11/1999 | Fukuda | 341/57 |
| 6,356,238 | B1 | 3/2002 | Gainor et al. | |
| 6,377,216 | B1 | 4/2002 | Cheadle et al. | |
| 6,433,743 | B1 | 8/2002 | Massey et al. | |
| 6,483,469 | B2 | 11/2002 | Boyle | |
| 6,590,540 | B1 | 7/2003 | Adams et al. | |
| 6,680,707 | B2 | 1/2004 | Allen et al. | |
| 6,762,730 | B2 * | 7/2004 | Schadler | 343/770 |
| 6,771,224 | B2 | 8/2004 | Apostolos | |
| 6,788,262 | B1 | 9/2004 | Adams et al. | |
| 6,867,740 | B2 | 3/2005 | Goodyear | |
| 6,919,850 | B2 | 7/2005 | Kennedy et al. | |
| 7,193,576 | B2 * | 3/2007 | Yazdandoost et al. | 343/767 |
| 2006/0001584 | A1 * | 1/2006 | Durso et al. | 343/718 |
| 2006/0022882 | A1 * | 2/2006 | Gerder et al. | 343/718 |

OTHER PUBLICATIONS

C.A. Balanis, Antenna Theory: Analysis and Design, 2nd Edition, Wiley, New York, 1997.

T. Yang et al., "Wearable Ultra-Wideband Half-Disk Antennas," 2005 IEEE Ant. & Prop. Symp., Washington DC Jul. 2005.

P. Salonen et al., "Effect of textile materials on wearable antenna performance: a case study of GPS antennas," 2004 IEEE Ant. & Prop. Symp., Moneterey CA, Jul. 2004.

P.Salonen and H. Hurme, "A novel fabric WLAN antenna for wearable applications," 2003 IEEE Ant. & Prop. Symp., Columbus OH, Jul. 2003.

C. Cibin et al., "A flexible wearable antenna," 2004 IEEE Ant. & Prop. Symp., Moneterey CA, Jul. 2004.

R.W.P. King, The Theory of Linear Antennas, Harvard University Press, Cambridge MA 1956.

(Continued)

*Primary Examiner*—Trinh V Dinh
(74) *Attorney, Agent, or Firm*—MH2 Technology Law Group LLP

(57) ABSTRACT

Embodiments relate generally to a body wearable antenna configuration comprising of a flexible multi-layered structure. Each layer has a property that contributes to the overall response of the antenna. The properties of each layer optimized to give the best overall response of the antenna.

12 Claims, 6 Drawing Sheets

OTHER PUBLICATIONS

C.P. Huang et al., "Analysis and design of tapered meander line antennas for mobile communications," Appl. Comput. Electromagn. Soc. J. (AES) vol. 15, pp. 159-166, 2000.

K.Y. Yazdandoost and R. Kohno, "CRL-UWB consortium ultra-wideband printed bow tie antenna," IEEE P.802.15-03/380r0, Sep. 2003.

H.S. Tsai and R.A. York, "FDTD analysis of CPW fed folded slot and multiple slot antennas on thin substrates," IEEE Trans. Ant. & Prop. vol. 44, pp. 217-226, Feb. 1996.

K.S. Yngvesson, et al., "Endfire tapered slot antennas on dielectric substrates," IEEE Trans. Ant. & Prop. vol. 33, pp. 1392-1400, Dec. 1985.

D.M. Pozar, Microwave Engineering, Addison-Wesley, Reading MA, 1993.

D.F. Sievenpiper, High-Impedance Electromagnetic Surgaces, Ph.D. dissertation, Dept. Elec. Eng., Univ. of California, Los Angeles, CA 1999.

F.R. Yang et al:, "A novel TEM waveguide using uniplanar compact photonic-bandgap (UC-PBG) structure," IEEE Trans on Microwave Thry. & Tech., vol. 47, pp. 2092-2098 Nov. 1999.

R.B. Waterhouse and D. Novak, "Comparison of performance of artificial magnetic conductors at L-band," 2005 IEEE Ant. & Prop. Symp., Washington DC Jul. 2005.

* cited by examiner

ANTENNA FOR EFFICIENT BODY WEARABLE APPLICATIONS

FIELD OF THE INVENTION

The subject matter of this application relates to antennas. More particularly, the subject matter of this application relates to the apparatus and elements of a flexible body wearable antenna.

BACKGROUND OF THE INVENTION

Body wearable antenna technology has received considerable attention recently due to the attractive feature of being able to provide an antenna platform that is unobtrusive and therefore potentially more robust compared to conventional external radiator platforms such as 'whip' style antennas. The particular focus of body wearable technology has so far centered on vest mounted antenna systems due to the large available area and the ease of integration with the radio equipment, which is typically located in a backpack or within the vest. There has also been a concerted effort investigating the development of body wearable antennas on clothing fabrics rather than the more conventional technologies such as microwave laminates. While some potentially useful results have been achieved with body wearable antennas for narrowband applications less than 1 GHz, incorporating body wearable radiators generally compromises the overall radiation efficiency as the human body absorbs radiation in this frequency range. There has also been considerable activity in the investigation of patch based antennas for body wearable applications. Due to the relationship between the height of this form of printed antenna and the radiator bandwidth, however, patches are really only useful for frequencies above 2 GHz.

Thus, there is a need to overcome these and other problems of the prior art associated with body wearable antennas.

SUMMARY OF THE INVENTION

In accordance with an embodiment of the invention, there is a novel process to develop efficient, low cost antenna platforms that are compliant with the requirements for body wearable systems. The antenna comprises of multiple layers of flexible laminates, each designed to give an overall optimal performance. The layers can include the protective layer, the radiator/feed layer, the spacer layer, and the optional user isolation layer. Through careful design of these layers an efficient, light-weight, low cost body wearable antenna can be developed.

Embodiments relate generally to a body wearable antenna configuration comprising of a flexible multi-layered structure. Each layer has a property that contributes to the overall response of the antenna. The properties of each layer optimized to give the best overall response of the antenna.

It can be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention and give examples of how the invention can be implemented.

DESCRIPTION OF THE EMBODIMENTS

In the following description, reference is made to the accompanying drawings that form a part thereof, and in which are shown, by way of illustration, specific exemplary embodiments in which the invention may be practiced. These embodiments are described in sufficient detail to enable those skilled in the art to practice the invention and it is to be understood that other embodiments may be utilized and that changes may be made without departing from the scope of the invention. The following description is, therefore, not to be taken in a limited sense.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

Figure 1:
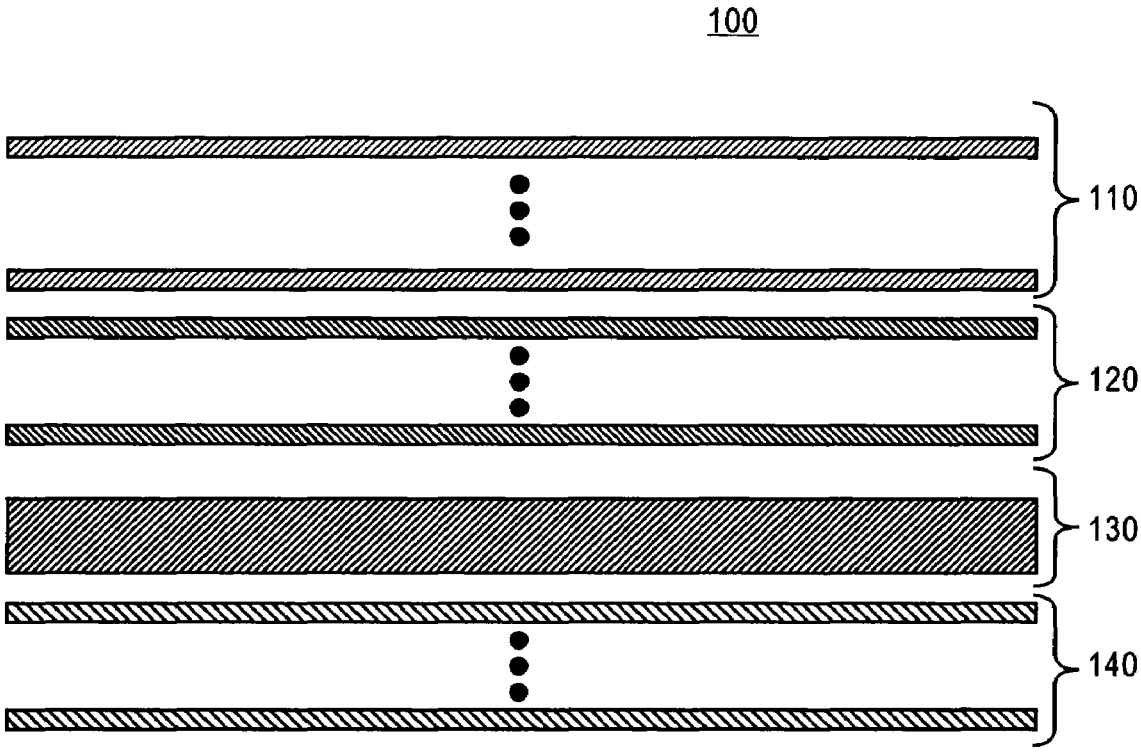
FIG. 1 is a schematic diagram of the cross-sectional view of a multilayered geometry of a flexible body wearable antenna. There are four general layers of the body wearable antenna; each can consist of several flexible laminates or materials in order to optimize the overall performance of the antenna. The four layers are the protection layer, the antenna/feed layer, the spacer layer, and the optional user isolation layer. Each of these layers has a specific role and is paramount in establishing a high performance body wearable antenna. It is this layered arrangement and the optimization of each layer that is the focus of this invention.

FIG. 1 shows a schematic of the proposed body wearable antenna system, which is a multi-layered flexible antenna 100. The multi-layered flexible antenna 100 can comprise a protective layer 110, a radiating layer 120, and a spacer layer 130. In other embodiments, the multi-layered flexible antenna 100 can also comprise an optional user isolation layer 140. According to various embodiments, each of the various layers described herein can be single or multiple layers and can also be formed from flexible laminates or materials. It is this arrangement of function optimized layers that the principle of this invention is based upon.

According to various embodiments, the protective layer 110 can be considered a top layer and its objective is to ensure that conductors associated with the antenna are protected from the environment and surroundings. The protective layer 110 can comprise multiple layers which can be laminates, and/or textile fabrics. The protective layer 110 layer is formed directly above the antenna/feed layer and is very important for ensuring an efficient body wearable antenna solution. For embodiments operating at frequencies above 2 GHz, the protective layer 110 can comprise a substantially thin layer of low loss laminate that can separate the radiating layer 120 from the cloth/fabric layer that covers the antenna assembly. This thin, low loss material helps with the overall efficiency of the antenna, as the layers directly above and below the radiating layer 120 have a considerable impact on the overall radiation efficiency. The protective layer 110 directly above the radiating layer 120 can also be used to reduce the size of the antenna 100 by the phenomenon of dielectric loading, in accordance with present teachings. Thus the dielectric constant of the protective layer 110 may range from 1 to 20, however it is not limited to this range. The thickness of the protective layer 110 may range up to 5 mm, although the thicker the material, the less flexible.

According to various embodiments, the radiating layer 120 in the proposed flexible body wearable antenna shown in FIG. 1 can be a layer of the antenna 100 where a radiating element and feed are located, either uni-planar or multi-layered. The radiating layer 120 can include at least one metallization layer. Fabrication of the radiating layer 120 can be carried out using standard printed circuit etching procedures, electrodepositing techniques or equivalent procedures. Moreover, uni-planar radiators such as printed monopoles (including meander line versions), bow-tie radiators, folded slot antennas, and tapered slot antennas, can be incorporated into the design. Multiple layered radiators such as patch antennas, or planar inverted F antennas can also be incorporated into the design. To give an efficient and optimal solution, the radiating layers must be low loss. Of all the layers associated with these embodiments, it is imperative that the radiating layers have the lowest loss tangent, due to their direct contact with the conductor forming the antenna and feed.

To be compliant with a low cost uni-planar antenna embodiment, a feed line, which can be included in radiating layer 120, can also be uni-planar. Examples of antenna feed lines that are uni-planar include co-planar waveguides (CPWs) and co-planar strip lines (CPS). These feeding techniques when integrated with the uni-planar radiators yield a low cost antenna solution. The feed for the multi-layer radiators can also be uni-planar or microstrip lines, or coaxial cables.

According to various embodiments, the radiating layer 120 can be a laminate and can have a low loss tangent and a high dielectric constant so as to provide a more compact solution. The radiating layer 120 can be made from a variety of substrate materials, including polytetrafluoroethylene or other polymers. Thus the dielectric constant of the radiating layer 120 may range from 1 to 20, however it is not limited to this range. The thickness of the radiating layer 120 may range from 0.1 mm to 5 mm, although the thicker the material, the less flexible in the overall antenna 100.

Figure 2:
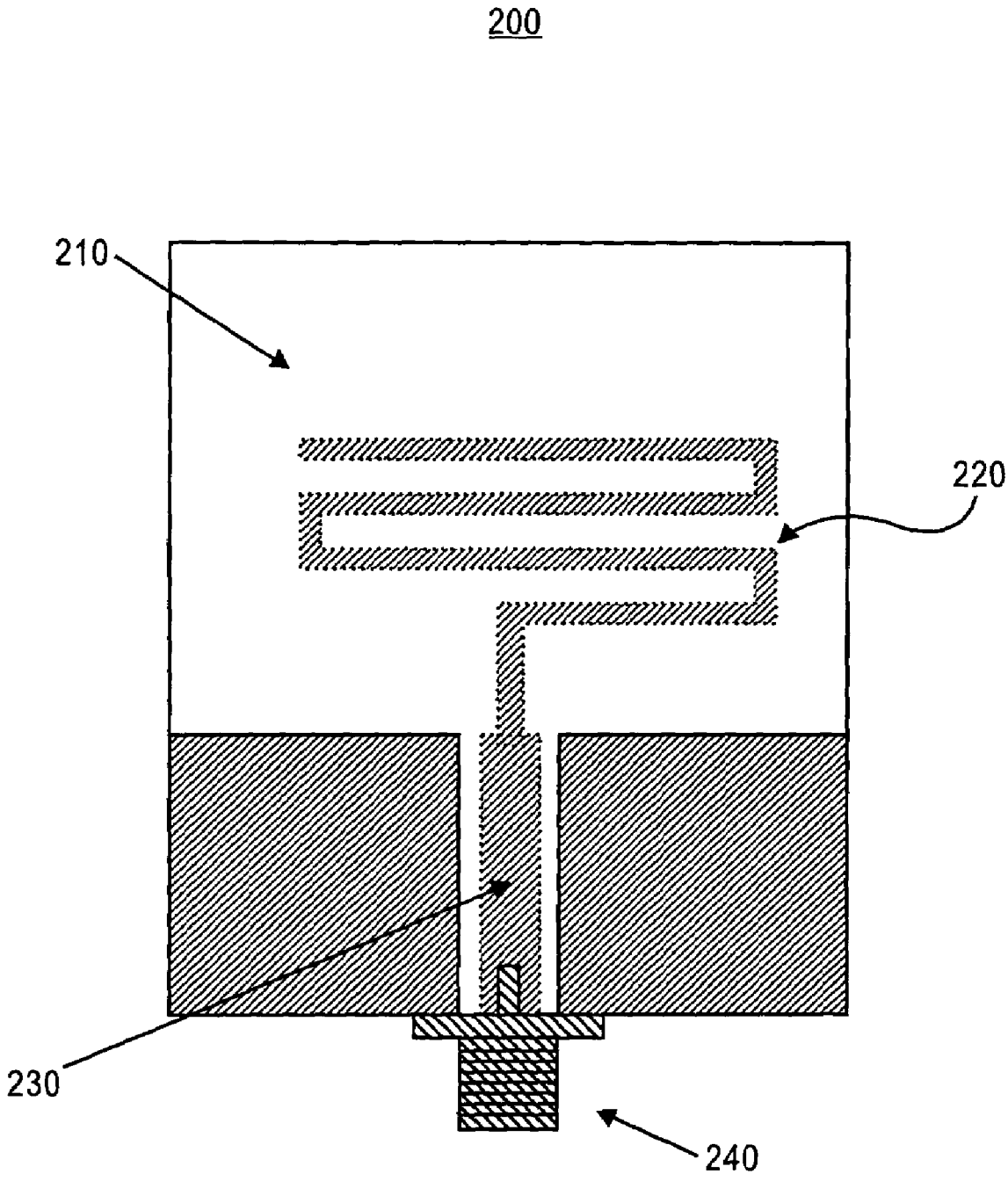
FIG. 2 is a schematic diagram of a portion of the antenna/feed layer of the multi-layer flexible body wearable antenna in accordance with the present teachings. The radiator is an example of a narrowband uni-planar printed antenna and feed configuration and consists of a meander line monopole and a co-planar waveguide (CPW) feed transmission line.
Figure 3:
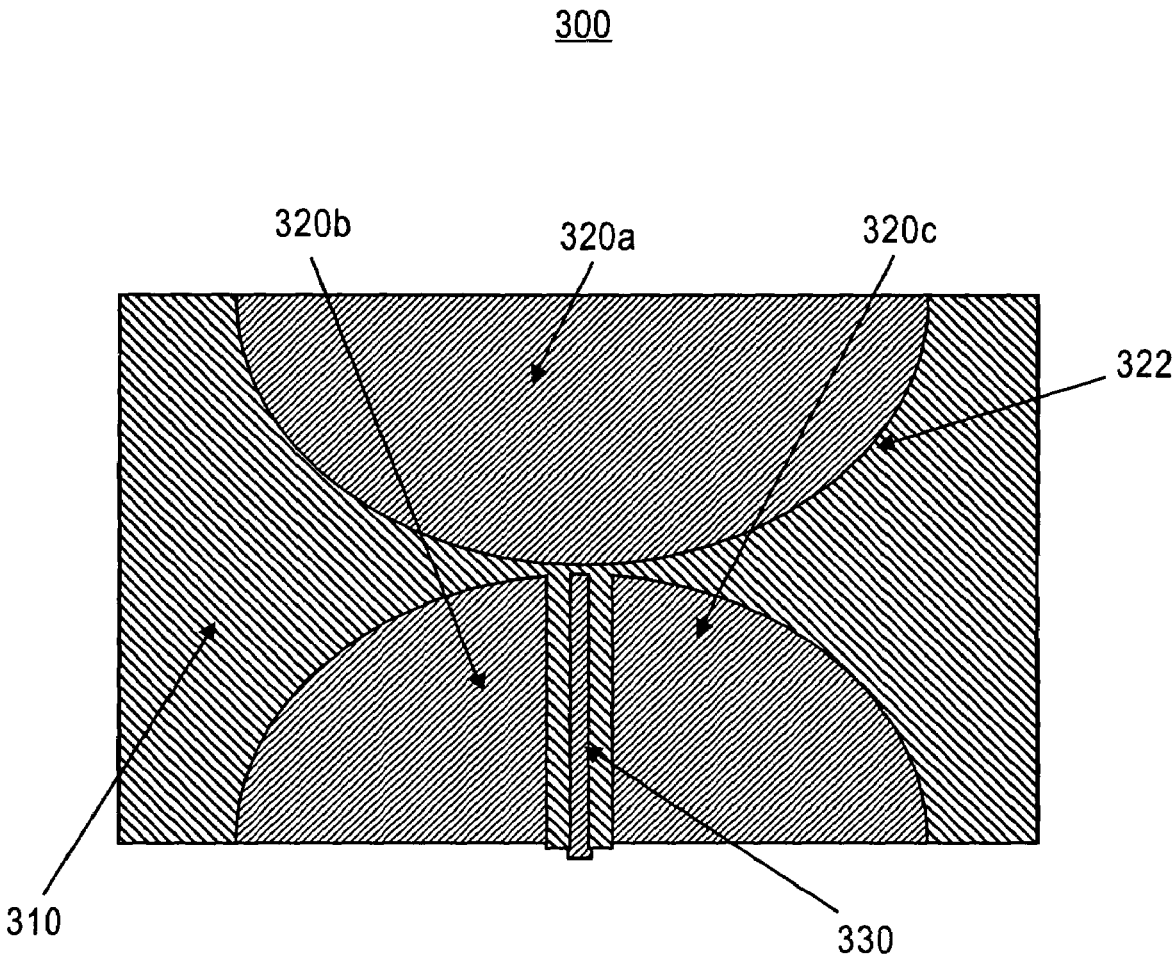
FIG. 3 is a schematic diagram of a portion of the antenna/feed layer of another multi-layer flexible body wearable antenna in accordance with the present teachings. The radiator is an example of a wideband uni-planar printed antenna and feed configuration and consists of a profile optimized bow-tie slot radiator and a CPW feed transmission line.

FIG. 2 shows an example of a narrowband uni-planar radiator and feed configuration 200 in accordance with the present teaching and FIG. 3 shows an example of a wideband uni-planar radiator 300 in accordance with the present teaching. The uni-planar radiator 200 shown in FIG. 2 can be formed in the radiating layer 120 of the body wearable antenna in accordance with the present teachings. The uni-planar radiator 200 can comprise a substrate 210 (the radiating layer), a meander line uni-planar monopole radiator 220, a co-planar waveguide feed line 230 formed on a ground plane 232, and a connector 240. According to various embodiments, the substrate 210 can comprise a dielectric material or a laminate of dielectric materials, such as, for example, polytetrafluoroethylene and can have dielectric constant and thickness ranges as previously described. In the example of a uni-planar radiator shown in FIG. 2, the center conductor or hot electrode of the CPW feed line 230 can be extended beyond the ground plane of the CPW transmission line to create the meander line uni-planar monopole radiator 220. The CPW transmission line ground plane acts as the ground plane for the monopole.

The meander line uni-planar monopole radiator 220 in FIG. 2 is formed by being folded back onto itself, which can reduce the overall size of the antenna 100. Moreover, mitered bends can be used to ensure the discontinuities associated with the folding of the radiating conductor do not adversely impact the impedance response of the antenna 100. Further, the radiator 220 and feed 230 can be fabricated on a single laminate substrate (or radiating layer 120) with no ground plane located at the base of the substrate. In the embodiment shown in FIG. 2, a connector 240 can be attached to the CPW feed line 230 to connect the antenna to a cable or other RF equipment or devices.

The wideband uni-planar radiator configuration 300 shown in FIG. 3 can be formed in the radiating layer 120 of the body wearable antenna in accordance with the present teachings. The wideband uni-planar radiator configuration 300 can be formed as an optimized bow-tie slot radiator, as shown in FIG. 3. Moreover, the wideband uni-planar radiator configuration 300 can comprise a substrate 310 (the radiating layer 120), ground planes 320*a-c*, and a co-planar waveguide feed line 330. According to various embodiments, the substrate 310 can comprise a dielectric material or a laminate of dielectric materials, such as, for example, polytetrafluoroethylene. As for the case of the narrow band radiator, the substrate 310 (radiating layer 120) can have dielectric constant and thickness ranges as previously discussed. Moreover, the CPW and the ground planes 320*a-c* can comprise a material such as copper.

According to various embodiments, the wideband uni-polar radiator can be fed by the co-planar waveguide feed line 330. In certain embodiments, an exponential profile can be used to taper the slot from the feed point 330 of the ground plane 320*a* to its outer dimension. The exponential taper profile 322 can provide an electromagnetically smooth transition that can give the radiator broadband characteristics. According to various embodiments, the CPW feed transmission line in FIG. 3 can have an impedance of 50 Ω. Moreover, the slot lines where the 50 Ω CPW feed line is terminated can have an impedance of 100 Ω. This can ensure an efficient transfer of power to the two arms of the radiator.

Turning again to FIG. 1, the spacer layer 130 in the proposed body wearable antenna can be formed directly below the radiator/feed layer 120. According to various embodiments, the spacer layer 130 can comprise a flexible, low dielectric constant laminate, foam, or other material which can ensure that electric fields associated with the radiator layer are not concentrated in the spacer layer region of the overall antenna. In general the dielectric constant of the spacer layer 130 must be lower than the radiating layer 120. The spacer layer 130 can be used to ensure that there is sufficient separation between the radiating element and the surrounding environment below the antenna. This surrounding environment can be armor material or can be the user, both of which can detrimentally impact the performance of the body wearable antenna.

The depth of the spacer layer 130 can be set by the maximum volume permissible for the application. In certain embodiments, however, a thicker spacer layer 130 can lessen the impact that the surrounding environment may have on the overall performance of the body wearable antenna. The loss tangent of the spacer layer 130 should be as low as possible to ensure an efficient antenna solution. For example, the spacer layer 130 loss tangent can be less than approximately 0.1.

According to various embodiments, the antenna 100 can include an optional user isolation layer 140, as shown FIG. 1. For example, the optional user isolation layer 140 can minimize the impact that the user and the surrounding environment have on the performance of the antenna 100. The user isolation layer 140 can comprise a single layer or multiple layers such as in a laminate. Depending on the isolation requirements, the user isolation layer 140 can comprise an additional spacer material, such as an artificial magnetic conductor (AMC), and/or other isolation enhancing material.

Figure 4:
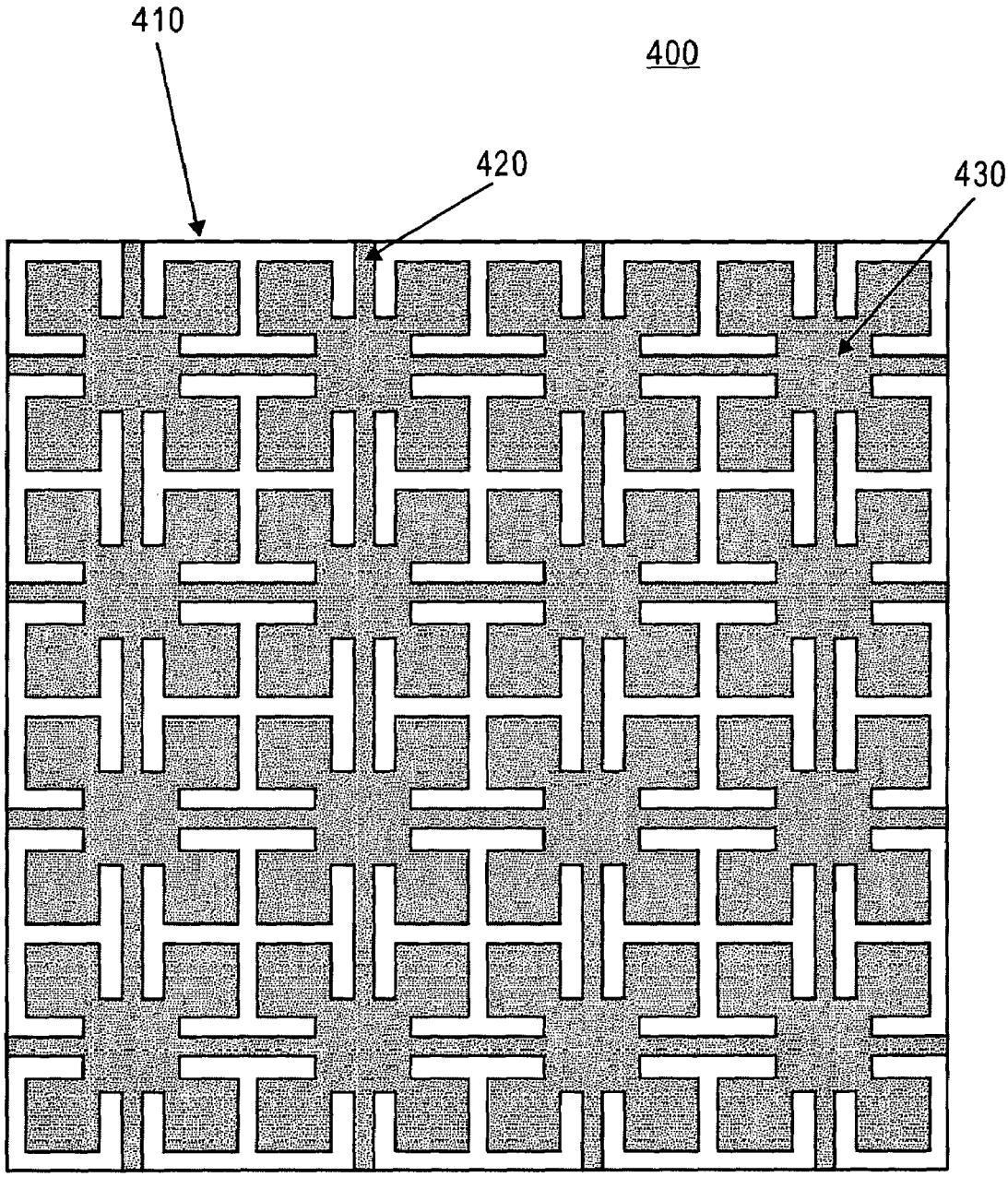
FIG. 4 is a schematic diagram of a portion of the isolation layer of a multi-layer flexible body wearable antenna in accordance with the present teachings. The structure is an example of a uni-planar artificial magnetic conductor developed on a grounded substrate.

FIG. 4 shows an exemplary AMC structure 400 that can be used for the optional user isolation layer 140 of the flexible body wearable antenna 100. Generally, an AMC, also commonly known as a metamaterial, electromagnetic bandgap material or high impedance ground plane, is a lossless, reactive surface that inhibits the flow of tangential electric surface current. As such, the AMC approximates a zero tangential magnetic field and results in a high equivalent surface impedance over a limited band of frequencies. This property of an AMC can have at least two consequences. For example, wire antennas or electric currents, can be placed in close proximity to the AMC without adversely affecting the input impedance of the antenna. Furthermore, both transverse magnetic (TM) and transverse electric (TE) surface waves can be 'cut off' over a range of frequencies with the use of an AMC. AMCs can readily be realized using printed circuit board fabrication procedures.

The exemplary AMC structure 400 shown in FIG. 4 is a uni-planar AMC. The AMC can comprise a grounded substrate 410, conductor tracts 420, and conductive pads 430. According to various embodiments, the thin conducting tracts 420 can be used to connect the larger conductive pads 430, all of which can be formed on the grounded substrate 410 to form the AMC 400. The AMC structure 400 shown in FIG. 4 can be situated below the spacer layer 130 in the body wearable antenna 100 shown in FIG. 1.

Figure 5:
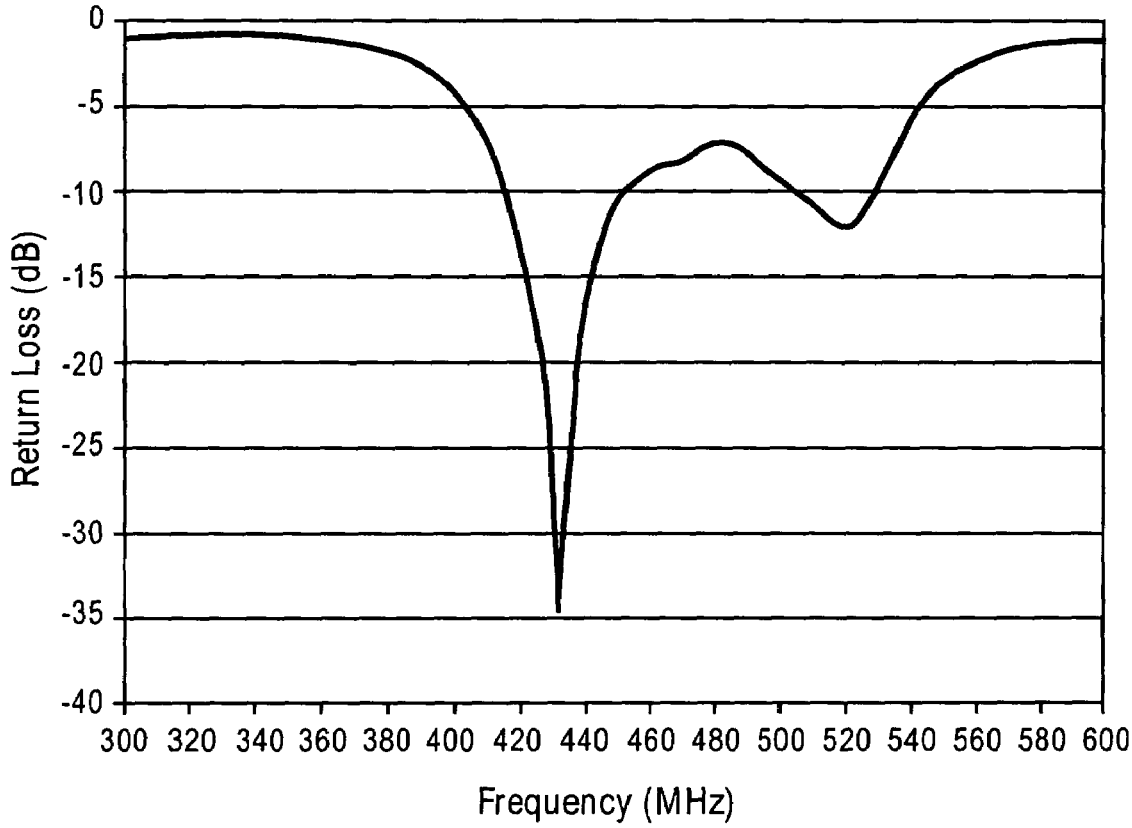
FIG. 5 shows the return loss of a body wearable antenna developed using the concepts and principles highlighted herein.

FIG. 5 shows the return loss of a body wearable antenna with a design based on the proposed structure presented in FIG. 1 and uses a uni-planar radiator similar in form to the monopole shown in FIG. 2. The antenna example shown has been designed for operation near 420 MHz. In this particular embodiment the protective layer 110 is a 0.125 mm thick polytetrafluoroethylene laminate with a dielectric constant of 2.2, the radiating layer 120 is a 0.254 mm thick polytetrafluoroethylene laminate with a dielectric constant of 2.2, the spacer layer 130 is 2 mm flexible foam with a low loss tangent and the isolation layer is 3 mm flexible foam.

Figure 6:
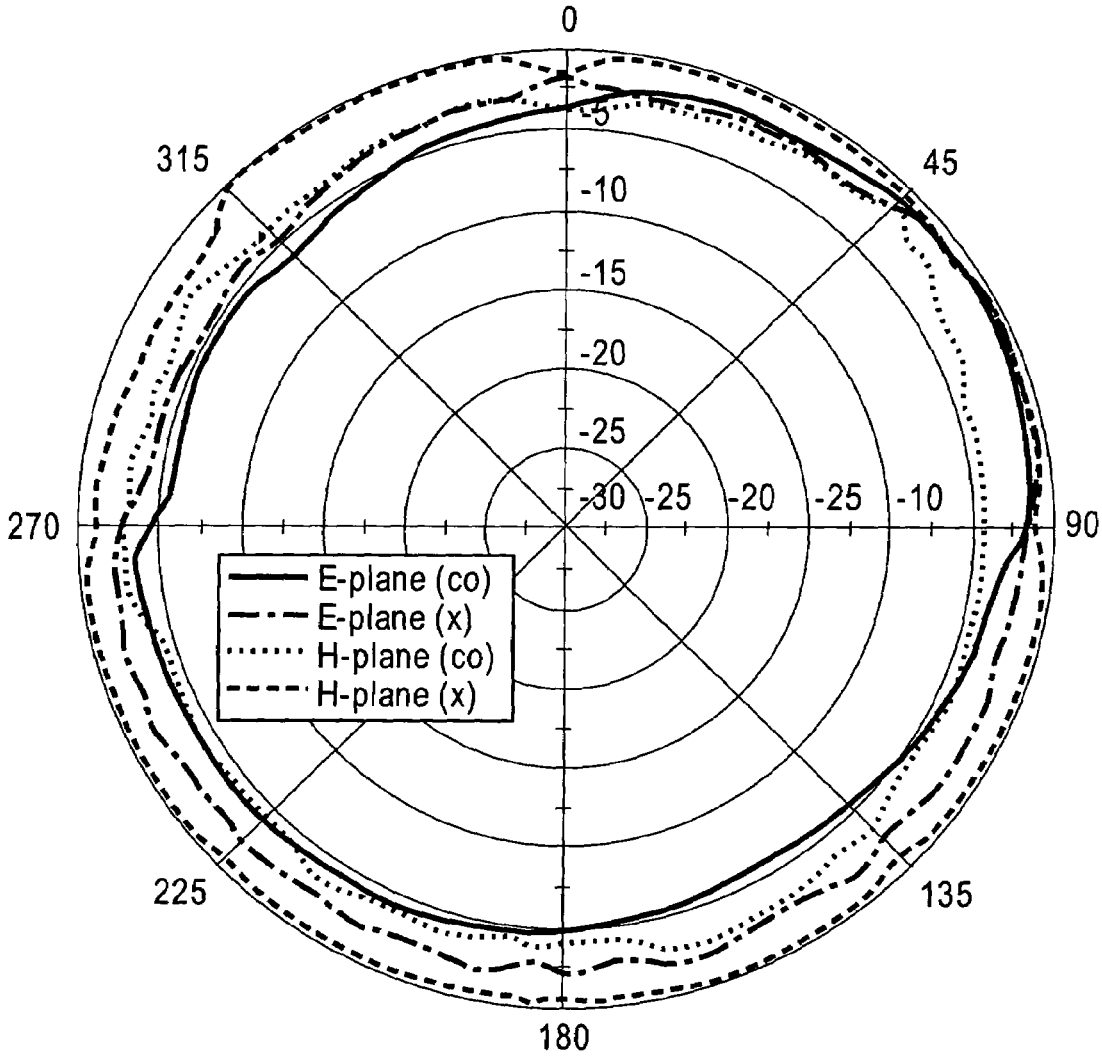
FIG. 6 shows the radiation patterns of the body wearable antenna developed based on the concepts developed herein.

FIG. 6 shows an example of the radiation patterns of the proposed body wearable antenna developed using the concepts summarized herein and highlights the omni-directional nature of the antenna concept.

While the invention has been illustrated with respect to one or more implementations, alterations and/or modifications can be made to the illustrated examples or embodiments without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising."

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A body wearable antenna configuration having a flexible multi-layered structure, each layer having a property contributing to the overall response of the antenna, the flexible multi-layered structure comprising:

a flexible protective layer;

a flexible radiation layer positioned below the flexible protective layer, wherein the radiation layer comprises, a radiator; and a feed; and a spacer layer comprising a flexible material having a dielectric constant ranging from approximately 1 to approximately 10, and a loss tangent less than approximately 0.1, contacting the flexible radiation layer and a surrounding environment, wherein at least one of the dielectric constant, loss tangent, and size of the spacer layer is selected to minimize the concentration of electric fields below the spacer layer.

2. The body wearable antenna configuration of claim 1 further comprising:

a user isolation layer contacting the spacer layer to the surrounding environment wherein the user isolation layer is configured to isolate an interaction of electric fields from a user or the surrounding environment.

3. The body wearable antenna configuration of claim 2, wherein the user isolation layer is implemented with an artificial magnetic conductor structure.

4. The body wearable antenna configuration of claim 1, wherein the protective layer is configured to protect the antenna from the surroundings and environment and wherein the protective layer is constructed of at least one of cloth fabrics, textiles, or laminates.

5. The body wearable antenna configuration of claim 1, wherein the radiator and feed are constructed in a single plane.

6. The body wearable antenna configuration of claim 5, wherein the radiator is one of a narrowband or a wideband and implemented as one of a meander line monopole or a bow tie slot radiator.

7. The body wearable antenna configuration of claim 1, wherein the radiator and feed enable a multi-layer radiator.

8. The body wearable antenna configuration of claim 7, wherein the radiator is one of a narrowband or a wideband and implemented as one of a microstrip patch.

9. The body wearable antenna configuration of claim 1, wherein the feed is implemented as one of a co-planar waveguide transmission line, and a co-planar strip line.

10. The body wearable antenna configuration according to claim 1, wherein the radiator and feed enables an efficient multi-layer feed network as one of a microstrip line and a coaxial cable.

11. The body wearable antenna configuration of claim 1, wherein the spacer layer is configured to provide sufficient separation between the radiation layer and the user to reduce the impact of external factors that impact on the performance of the antenna.

12. The body wearable antenna configuration according to claim 1, wherein the spacer layer comprises at least one material having a dielectric constant less than a dielectric constant of the radiation layer.

* * * * *